US005981068A

United States Patent [19]

Tsujiyama et al.

[11] Patent Number: 5,981,068

[45] **Date of Patent: *Nov. 9, 1999**

[54] MODIFIED POLYOLEFIN FIBERS AND A NON-WOVEN FABRIC USING THE SAME

[75] Inventors: Yoshimi Tsujiyama; Masahiko Taniguchi; Hidemi Ito; Masahito Katsuya, all of Shigaken, Japan

[73] Assignee: Chisso Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,572

[22] Filed: Mar. 26, 1997

Related U.S. Application Data

[63] Continuation of application No. 08/590,380, Jan. 25, 1996, abandoned.

[30] Foreign Application Priority Data

Feb. 2, 1995 [JP] Japan ..... 7-039138

[51] Int. Cl.[6] ..... B32B 27/00

[52] U.S. Cl. ..... 428/394; 524/314

[58] Field of Search ..... 524/214; 428/394

[56] References Cited

U.S. PATENT DOCUMENTS 5,087,520 2/1992 Suzuki et al. ..... 428/389

5,130,196 7/1992 Nisshio et al. ..... 428/373

FOREIGN PATENT DOCUMENTS 0503590 9/1992 European Pat. Off. .

0557889 9/1993 European Pat. Off. .

0632148 1/1995 European Pat. Off. .

62-156310 7/1987 Japan .

2-112456 4/1990 Japan .

2-264012 10/1990 Japan .

*Primary Examiner*—Peter D. Mulcahy

*Attorney, Agent, or Firm*—McDermott, Will & Emery

[57] ABSTRACT

Modified polyolefin fibers capable of easily producing a non-woven fabric having a high strength and a superior feeling, and provided with a broad range of processing temperature and further a low temperature adhesiveness and suitable to heating roll processing, and a non-woven fabric using the same are provided, which fibers are obtained by adhering 0.1 to 1.0% by weight of an oiling agent composed mainly of a dibasic acid ester and/or a fatty acid ester, to polyolefin fibers having an index of birefringence of 0.054 or less, and which non-woven fabric has a strength of 0.85 or higher (Kg/5 cm) at 134° C. and a processing temperature width of 132° to 138° C.

10 Claims, No Drawings

MODIFIED POLYOLEFIN FIBERS AND A NON-WOVEN FABRIC USING THE SAME

This application is a continuation of application Ser. No. 08/590,380 filed Jan. 25, 1996 ABN.

BACKGROUND OF THE INVENTION

1. Field of the Invention

This invention relates to modified polyolefin fibers preferred as a raw material for a hot-melt-adhesive polyolefin non-woven fabric and the non-woven fabric. More particularly, it relates to modified polyolefin fibers having a superior card-passing through property at the time of processing a non-woven fabric, and a low temperature adhesion and a broad width of processing temperature, and also having superior working characteristics on heating rolls, and a non-woven fabric.

2. Description of the Related Art

Hot-melt-adhesive type non-woven fabrics have been broadly used in view of advantages of provisions, economy, hygienics, etc., because the fabrics do not require any binder. Among the fabrics, polyolefin non-woven fabrics are superior in the properties and economy; hence they have been used in many fields such as those of surface materials for paper diaper, goods for menses, etc., medical or hygienic materials for operating gown, etc., civil engineering materials, agricultural materials, industrial materials, etc., and conjugate fibers of polyethylene/polypropylene and single fibers of polypropylene, etc. have been used as raw material fibers therefor.

The method for processing hot-melt-adhesive non-woven fabrics is roughly classified into an air-through process using hot air and heating roll process. Among these, the air-through process is applied to polyethylene/polypropylene conjugate fibers. Non-woven fabric obtained according to the air-through process is strong and soft, but the processing speed is slower than that by means of heating roll process and the processing is inferior in the productivity. Further, since polyethylene/polypropylene conjugate fibers are used, there is a drawback of a waxy feeling specific of polyethylene.

On the other hand, heating roll process has a high processing speed and a high productivity, and hot-melt-adhesion is carried out; hence even when polypropylene single fibers are used, it is possible to make a non-woven fabric from the fibers, and there is an advantage that there is no waxy feeling due to polyethylene.

However, it has been regarded as difficult to produce a polypropylene non-woven fabric provided with both of strength and a soft feeling according to heating roll process. The reason is as follows:

In order to produce the polypropylene non-woven fabric by means of heating roll, it is necessary to improve the hot-melt-adhesion between polypropylene fibers, and it is therefor necessary to produce the non-woven fabric at a high temperature at which the polypropylene fibers sufficiently soften at the time of hot-melt-adhesion bonding thereof.

However, when the non-woven fabric is produced at such a high temperature, the hot-melt-adhesion bonded points are deformed into a film form, and the polypropylene fibers other than the bonded points are also affected by heat, so that the feeling becomes inferior. Further, when processing is carried out at a low temperature, hot-melt-adhesion at the bonded points is insufficient, and strength endurable to practical uses cannot be obtained. Thus, the range of production conditions under which a propylene non-woven fabric being strong and having a soft feeling can be obtained, is very narrow, so that there has been raised a problem of production that strength lowers due to a small change in the processing temperature and the feeling becomes hard. Thus, it has been awaited to develop polypropylene fibers having a broad processing temperature for obtaining a soft and strong polypropylene non-woven fabric, and suitable to heat-rolling process.

Japanese patent application laid-open No. Sho 62-156310 proposes, as polypropylene fibers suitable to heat-rolling process, polypropylene fibers composed of ethylene-propylene random copolymer containing a definite quantity of ethylene and having a softening point of 132° C. or lower. However, the fibers have drawbacks that they have hard feeling and the processing temperature range wherein it is possible to produce a non-woven fabric provided with both of strength suitable to practical uses and feeling, is very narrow.

Further, Japanese patent application laid-open No. Hei 2-112456 discloses a non-woven fabric composed of fibers of polypropylene having a specified isotactic pentad fraction. This non-woven fabric has a good feeling, but its strength is insufficient. Further, in general, the fibers composed of such a low stereoregular polypropylene have inferior carding characteristics; hence the fibers have drawbacks such that a serious problem occurs in the intrinsic production of non-woven fabric.

Further, Japanese patent application laid-open No. Hei 2-264012 proposes polypropylene fibers having 1,3,5-trimethyl-2,4,6-trisbenzene and dimyristyl-3,3'-thiodipropionic acid ester blended therein, but the feeling and tenacity thereof are both insufficient.

Problem to be Solved by the Invention

As described above, a number of attempts to provide a polypropylene non-woven fabric having superior strength and feeling according to heating roll processing have been carried out, but the properties of the produced non-woven fabrics are insufficient, and the processing temperature range at the time of production thereof is narrow; thus, satisfactory polypropylene fibers have not yet been developed.

The present inventors have made strenuous research in order to solve the above problems, and as a result, have found that a product obtained by adhering an oiling agent composed mainly of a dibasic acid ester and/or a fatty acid ester onto polyolefin fibers of low orientation having an index of birefringence of 0.054 or less exhibits the aimed high strength of non-woven fabric and softness even within a low processing temperature range, and have completed the present invention.

As apparent from the foregoing, the object of the present invention is to provide superior polyolefin fibers capable of easily producing a soft and high feeling polyolefin non-woven fabric, and having a broad processing temperature range and being suitable to heating roll processing.

SUMMARY OF THE INVENTION

This invention has the following constitutions (1) to (6):

(1) Modified polyolefin fibers having 0.1 to 1.0% by weight of an oiling agent composed mainly of a dibasic acid ester or an aliphatic acid ester or a dibasic acid ester and an aliphatic acid ester, adhered onto polyolefin fibers having an index of birefringence of 0.054 or less.

(2) Modified polyolefin fibers according to item (1), wherein the polyolefin fibers are polypropylene fibers.

(3) Modified polyolefin fibers according to item (1) or (2), wherein the polyolefin fibers are those of an olefin bipolymer or terpolymer, composed of propylene as main component and ethylene or butene-1.

(4) Modified polyolefin fibers according to item (1), wherein said dibasic acid ester is that of at least one member selected from the group consisting of adipic acid, sebasic acid, phthalic acid, terephthalic acid, succinic acid and maleic acid.

(5) Modified polyolefin fibers according to item (1), wherein said aliphatic acid ester is an ester of at least one acid selected from the group consisting of caprylic acid, capric acid, lauric acid, myristic acid, palmitic acid and stearic acid.

(6) A modified polyolefin non-woven fabric characterized by using modified polyolefin fibers set forth in either one one of items (1) to (5).

The present invention will be described in more detail.

The polyolefin fibers of the present invention refer to not only those of 100% propylene polymer but also those of olefin bipolymer or terpolymer composed mainly of propylene.

The olefin bipolymer composed mainly of propylene referred to in the present invention is directed to a random copolymer consisting of propylene of less than 100% and 85% or more and ethylene of more than 0% and less than 15%, or a random copolymer consisting of propylene of less than 100% and more than 50% and butene-1 of more than 0% and less than 50%. The olefin terpolymer composed mainly of propylene refers to a random copolymer consisting of propylene of more than 85% and less than 100%, ethylene of more than 0% and less than 10% and butene-1 of more than 0% and less than of 15%.

The above olefin bipolymer or terpolymer composed mainly of propylene is a solid polymer obtained by polymerizing propylene, ethylene and butene-1 in the presence of a conventional Ziegler-Natta type catalyst so as to give the above respective component contents, and it is essentially a random copolymer. Such polymers may be obtained according to a process of polymerizing mixed gas from the beginning, and besides, in order to improve the productivity, according to a polymerization process of obtaining 20% or less of polymer based upon the total polymer by propylene single polymerization, followed by feeding mixed gas of the respective components to polymerize them.

Further, it does not matter if the above bipolymer, terpolymer, etc. may have another polyolefin component capable of being blended, or a component other than polyolefin component, blended therewith, in a small quantity.

The modified polyolefin fibers of the present invention are produced so as to afford low orientation properties (index of birefringence=0.054 or less). Such low orientation properties are obtained by suppressing the stretching ratio employed at the time of spinning down to a stretching ratio (3 times or less) lower than that conventionally employed (about 4 times or more), and the stretching ratio is preferably 2.5 times or less, more preferably 2.0 times or less. If the stretching ratio exceeds 3.0 times, the molecular orientation is elevated, so that the heat-softening point and melting point rise and the hot-melt-adhesion lowers. Furthermore, it is impossible to obtain a sufficient function and effectiveness of penetration and adsorption of an oiling agent into the fibers as described later.

As the dibasic acid ester as a main component of the oiling agent used in the present invention, diesters of at least one member selected from the group of acids consisting of adipic acid, sebasic acid, phthalic acid, terephthalic acid, succinic acid and maleic acid, with an aliphatic alcohol can be exemplified. Particularly preferable examples are dioctyl adipate, dibutoxyethyl sebacate and dioctyl phthalate.

As the aliphatic acid ester, esters of at least one member of acids selected from the group consisting of caprylic acid, capric acid, lauric acid, myristic acid, palmitic acid, and stearic acid can be exemplified. Particularly preferable examples are methyl caprate, oclyl laurate and methyl palmitate.

The main component referred to herein means that it occupies 15% of the oiling agent. Further, the dibasic acid ester and the aliphatic acid ester can be adhered onto the polyolefin fibers, each alone or in mixed state. In addition, antistatic agent, emulsifying agent, etc. as components other than the dibasic acid ester and aliphatic acid ester may be blended, within a range of quantity not obstructing the effectiveness of the present invention. Among these agents, polyethylene glycol monoester or diester, Na alkylsulfonate, fatty acid amide, etc. are mentioned.

The percentage of the oiling agent adhered onto the polyolefin fibers in the present invention is within a range of 0.1 to 1.0% by weight, preferably 0.2 to 0.5% by weight. If the percentage of the oiling agent adhered is less than 0.1% by weight, the antistatic property at the carding process becomes inferior so that a formation unevenness occurs on the web; but it is impossible to make the line speed high in order to avoid the occurrence. If the quantity of the agent adhered is reduced, the penetration and adsorption of the agent into the surface part of the polyolefin fibers for promoting adhesion are insufficient so that it becomes difficult to form a skin layer having adsorbed the dibasic acid ester or aliphatic acid ester; hence improvement in the hot-melt-adhesion is obstructed.

The upper limit value of the percentage of the oiling agent adhered is preferred to be 1.0% by weight. Even if the percentage exceeds 1.0% by weight, no problem is raised upon antistatic properties, but such a percentage is undesirable since the excess penetrating adsorption into fibers lowers the fiber tenacity, and lowers the crimp retention, and the card-passing properties because of softening of the fiber surface becomes inferior.

As for the process for adhering the oiling agent to fibers, a known process may be employed, such as a process by means of touch roll during the fiber-spinning step, a process by means of touch roll during the stretching step, a process of spray adhesion after mechanical crimp process, etc.

As to the tensile strength of non-woven fabric obtained by heating roll process, when the bonding points of fibers are sufficiently tight, the strength usually depends greatly upon the single filament tenacity. On the other hand, when the bonding points are brittle, since the breaking of non-woven fabric occurs due to breakage of bonding points, the tensile strength of non-woven fabric is almost not influenced by single fiber tenacity, and yet the value is very small.

In the case of the modified polyolefin fibers of the present invention, by suppressing the molecular orientation of the fibers in a low stretching ratio of three times or less (an index of birefringence=0.54 or less), the penetrating function of the adhered oiling agent into the skin layer is promoted. As a result, since the swelled skin layer is easier in the heat softening as compared with the core layer, the heat softness is improved, so that it is possible to hot-melt-adhere the fiber bonding points at a low processing temperature which has no influence upon the core layer.

According to the present invention, by imparting an oiling agent composed mainly of a dibasic acid ester and/or a fatty acid ester to polyolefin fibers having the molecular orientation suppressed in a low stretching ratio of three times or less (an index of birefringence=0.054 or less), the dibasic acid ester and/or aliphatic acid ester are transferred by diffusion, from the polyolefin fiber surface to the surface layer part to form a skin layer having adsorbed the dibasic acid ester and/or aliphatic acid ester. The skin layer is swelled by the dibasic acid ester and/or aliphatic acid ester so that the skin layer has a lower density than that of the core layer and also has a lower softening point than that of the core layer. As a result, tight fiber bonding points can be prepared at a low processing temperature to exhibit a high non-woven fabric strength.

EXAMPLE

The present invention will be concretely described by way of Examples, but it should not be construed to be limited only to Examples.

In addition, the various values of physical properties described in Examples were measured according to the following methods:

Melt Flow Rate (MFR)

Measured according to the condition (L) of ASTM D 1238.

Strength of non-woven fabric

A test piece of 5 cm long and 15 cm lateral was cut off from a non-woven fabric having a basis weight of 20 g/m$^2$ and its breaking strength was measured by means of a tensile strength tester, under conditions of a test piece-gripping distance of 10 cm and a tensile speed of 10 cm/min.

Softness

Measured according to JIS L1018 (item 6.21A)

A non-woven fabric of 5 cm long and 15 cm laterial, cut off from a non-woven fabric having a basis weight of 20 g/m$^2$ was placed on a horizontal table (Cantilever type tester) having one smooth side slanted at 45° and having a scale graduated, so as to correspond to the scale, followed by softly sliding the non-woven fabric manually in the slant direction, and reading the delivery at the time of contact of one end of the non-woven fabric with the slant surface, in a unit of mm, to render the numeral value of the delivery, as an indication of the softness. The smaller the value, the better the softness of the non-woven fabric. When the value of softness is 30 mm or less, the feeling of the non-woven fabric is good. If the value of softness exceeds 30 mm, the feeling of the non-woven fabric is hard; hence it is impossible to use the fabric to use application of hygienic materials used in direct contact with the skin.

Processing Temperature Width

This refers to a temperature width of a heating roll affording a non-woven fabric furnished with properties of a softness of 30 mm or less and a strength of 0.6 Kg/5 cm or higher, and it is evaluation standards of low temperature adhesiveness and high processing temperature width. For example, if a non-woven fabric satisfying the conditions within a temperature range of 130° to 140° C., the processing temperature width is 10 (deg).

Low Temperature Processability

This was evaluated by the strength of a non-woven fabric processed at 134° C. (softness: 24 mm). A non-woven fabric having a higher strength is good.

Percentage of Oiling Agent Adhered

A sample (10 g) was extracted with a mixed solvent of methanol with petroleum ether (1:1) using a Soxhlet extractor, under reflux for 3 hours, followed by removing the solvent and measuring the weight.

Index of Birefringence

Its measurement was carried out by using a polarization microscope and by means of Babinet's compensator.

Examples 1 and 2 and Comparative Example 1

Fibers were melt-spun, using a polypropylene component of MFR 25 and at a spinning temperature of 310° C. At the drawing step just after spinning, oiling agents described in Table 1 were adhered by means of touch roll. After spinning, fibers were stretched to 1.5 times by a hot roll at 40° C., followed by imparting mechanical crimps by means of stuffing box, drying and cut-treating to prepare polypropylene short fibers of 2d×38 mm.

The short fibers were carded at a speed of 20 m/min. by a roller carding machine, to prepare a web having a basis weight of 20 g/m$^2$, followed by processing the web into a non-woven fabric by means of an embossing roll having an adhesion area percentage of 24% at the same speed. The heating temperature of the embossing roll was nicked each 0.5 (deg) within a range of 130° to 145° C. From the non-woven fabrics obtained at the respective heating temperatures, definite test pieces were prepared and the strength and softness thereof were measured. From the results, the strength, processing temperature and processing temperature width of the non-woven fabric at the time of low temperature processing at 134° C. (softness 24 mm) were sought. The values of the respective examples are shown in Tables 1 and 2 together with card-passing properties.

In Examples 1 and 2, the strength of the non-woven fabric at the time of low temperature processing at 134° C. (softness: 24 mm) was high, the processing temperature width was broad and the card-passing properties were good.

In Comparative example 1, the strength of the non-woven fabric at 134° C. (softness: 24 mm) was low, and the processing temperature width was narrow. The card-passing properties were inferior due to notable occurrence of static electricity.

Comparative Example 2

A non-woven fabric was prepared in the same manner as in Example 1 except that an oiling agent shown in Table 2 was used instead, and its characteristics were measured. The resulting non-woven fabric had a low strength and either of feeling, card-passing properties and processing temperature width were unsatisfactory.

Example 3

A non-woven fabric was prepared in the same manner as in Example 1 except that the stretching ratio was made 3 times, and its characteristics were measured. The non-woven fabric exhibited a high strength, and either of feeling, card-passing properties and processing temperature width were satisfactory.

Comparative Example 3

A non-woven fabric was prepared in the same manner as in Example 1 except that the stretching ratio was made 4 times, and its characteristics were measured. The same oiling agent as in Example 1 was adhered, but the index of birefringence was 0.072; no skin layer was formed due to high degree of orientation; the strength of the non-woven fabric was low; and the processing temperature width was narrow.

Thus, a satisfactory non-woven fabric was not obtained.

Example 4

A non-woven fabric was prepared in the same manner as in Example 1, except that a random copolymer of 99.8% of propylene with 0.2% of ethylene having an MFR of 25, and its characteristics were measured. The resulting non-woven fabric exhibited a high strength, and either of feeling, card-passing properties and processing temperature width were satisfactory.

Example 5

A non-woven fabric was prepared in the same manner as in Example 1, except that an oiling agent 2 shown in Table 1 was used instead, and its characteristics were measured. The resulting non-woven fabric exhibited a high strength and either of feeling, card-passing properties and processing temperature width were satisfactory.

Example 6

A non-woven fabric was prepared in the same manner as in Example 1, except that an oiling agent 3 shown in Table 1 was used instead, and its characteristics were measured. The resulting non-woven fabric exhibited a high strength and either of feeling, card-passing properties and processing temperature width were satisfactory.

TABLE 1

| | Example 1 | Example 2 | Example 3 | Example 4 | Example 5 | Example 6 |
|---|---|---|---|---|---|---|
| Oiling agent | Oiling agent 1 | Oiling agent 1 | Oiling agent 1 | Oiling agent 1 | Oiling agent 2 | Oiling agent 3 |
| Weight percentage of oiling agent adhered (%) | 0.20 | 0.55 | 0.30 | 0.30 | 0.40 | 0.30 |
| Card-passing properties | Good | Good | Good | Good | Good | Good |
| Strength of non-woven fabric at the time of processing at 134° C. (Kg/5 cm) | 0.95 | 0.95 | 0.90 | 0.95 | 0.9 | 0.85 |
| Processing temperature width (deg) | 6.0 | 6.0 | 5.0 | 6.0 | 6.0 | 6.0 |
| Processing temperature (° C.) | 132~138 | 132~138 | 133~138 | 132~138 | 132~138 | 132~138 |
| Index of birefringence | 0.030 | 0.035 | 0.054 | 0.036 | 0.042 | 0.038 |

TABLE 2

| | Comparative example 1 | Comparative example 2 | Comparative example 3 |
|---|---|---|---|
| Oiling agent | Oiling agent 1 | Oiling agent 4 | Oiling agent 1 |
| Weight percentage of oiling agent adhered (%) | 0.05 | 0.35 | 0.40 |
| Card-passing properties | Inferior | Good | Good |
| Strength of non-woven fabric at the time of processing at 134° C. (Kg/5 cm) | 0.55 | 0.4 | 0.35 |
| Processing temperature width (deg) | 3.0 | 2.0 | 1.0 |
| Processing temperature (° C.) | 135~138 | 136~138 | 137~138 |
| Index of birefringence | 0.036 | 0.032 | 0.072 |

TABLE 3

| Composition of oiling agent (weight %) | | | | | | | |
|---|---|---|---|---|---|---|---|
| Oiling agent 1 | | Oiling agent 2 | | Oiling agent 3 | | Oiling agent 4 | |
| PEG (400) dL | 40 | OL | 38 | dOA | 25 | PEG (400) dL | 50 |
| dOPh | 45 | PEG (500) mL | 42 | dML | 25 | PEG (500) mL | 50 |
| GmS | 10 | GmS | 10 | PEG (400) dL | 40 | | |
| SPhNa | 5 | SPhNa | 10 | SPhNa | 10 | | |

PEG (400) mL: polyethylene glycol (400) dilaurate
GmS: glycerine monostearate
SPhNa: cetyl phosphate
PEG (500) mL: polyethylene glycol (500) monolaurate
Dibasic acid ester
dOA: dioctyl adipate
dOPh: dioctyl phthalate
Aliphatic acid ester
OL: octyl laurate

EFFECTIVENESS OF THE INVENTION

By subjecting the modified polyolefin fibers of the present invention to heating roll processing, it is possible to produce a polyolefin non-woven fabric having a high strength and a soft feeling. Further, the non-woven fabric has a higher strength at the time of low temperature processing, as compared with conventional non-woven fabric, and since its processing temperature has a broad width, it is possible to easily produce the non-woven fabric.

What we claim is:

1. Modified polyolefin fibers having 0.1 to 1.0% by weight of an oiling agent consisting essentially of a dibasic acid ester of at least one member selected from the group of acids consisting of adipic acid, sebacic acid, phthalic acid, terephthalic acid, succinic and maleic acid with an aliphatic alcohol, or an aliphatic acid ester of at least one member of acids selected from the group consisting of caprylic acid, capric acid, lauric acid, myristic acid, palmitic acid and stearic acid with an alkyl monoalcohol or said dibasic acid ester and said aliphatic acid ester, adhered onto polyolefin fibers having an index of birefringence of 0.054 or less.

2. Modified polyolefin fibers according to claim 1, wherein the polyolefin fibers are polypropylene fibers.

3. Modified polyolefin fibers according to claim 1, wherein the polyolefin fibers are those of an olefin bipolymer or terpolymer, composed of propylene as main component and ethylene or butene-1.

4. Modified polyolefin fibers according to claim 1, wherein said dibasic acid ester is of at least one member selected from the group consisting of dioctyl adipate and dibutoxyethyl sebacate.

5. Modified polyolefin fibers according to claim 1, wherein said aliphatic acid ester is at least one acid selected from the group consisting of methyl caprate, octyl laurate and methyl palmitate.

6. A modified polyolefin non-woven fabric characterized by using modified polyolefin fibers set forth in claim 1.

7. Modified polyolefin fibers according to claim 1 wherein said dibasic acid ester is at least one member selected from the group consisting of dioctyl adipate, dibutoxyethyl sebacate and dioctyl phthalate.

8. Modified polyolefin fibers according to claim 1 wherein said aliphatic acid ester is at least one member selected from the group consisting of methyl caprate, octyl laurate and methyl palmitate.

9. A modified polyolefin fiber having an index of birefringence of 0.054 or less and having 0.1 to 1.0% by weight of an oiling agent adhered thereto, wherein the oiling agent consisting of an ester selected from the group of esters consisting of adipic acid, sebacic acid, phthalic acid, terephthalic acid, succinic and maleic acid with an aliphatic alcohol.

10. A modified polyolefin fiber having an index of birefringence of 0.054 or less and having 0.1 to 1.0% by weight of an oiling agent adhered thereto, wherein the oiling agent consisting of an ester selected from the group of esters consisting of caprylic acid, capric acid, lauric acid, myristic acid, palmitic acid and stearic acid with an alkyl monoalcohol.

* * * * *